US011043319B2

(12) United States Patent
Li et al.

(10) Patent No.: US 11,043,319 B2
(45) Date of Patent: Jun. 22, 2021

(54) SEPARATION OF MANGANESE BISMUTH POWDERS

(71) Applicant: Ford Global Technologies, LLC, Dearborn, MI (US)

(72) Inventors: Wanfeng Li, Novi, MI (US); Feng Liang, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 272 days.

(21) Appl. No.: 16/014,055

(22) Filed: Jun. 21, 2018

(65) Prior Publication Data

US 2019/0392969 A1 Dec. 26, 2019

(51) Int. Cl.

| | |
|---|---|
| ***H01F 1/047*** | (2006.01) |
| ***B22F 1/00*** | (2006.01) |
| ***C22C 22/00*** | (2006.01) |
| *C22C 12/00* | (2006.01) |
| *C22C 1/02* | (2006.01) |

(52) U.S. Cl.

CPC ..... *H01F 1/047* (2013.01); *B22F 1/0018* (2013.01); *C22C 22/00* (2013.01); *B22F 2301/40* (2013.01); *C22C 1/02* (2013.01); *C22C 12/00* (2013.01); *C22C 2202/02* (2013.01)

(58) Field of Classification Search

None

See application file for complete search history.

(56) References Cited

U.S. PATENT DOCUMENTS 4,781,821 A * 11/1988 Salmi ..... B03C 1/14 209/214
9,418,779 B2 8/2016 Choi et al.
9,847,157 B1 12/2017 Rowe et al.
2013/0240413 A1* 9/2013 Keaton ..... B03C 1/10 209/3.1

FOREIGN PATENT DOCUMENTS

SU 1669557 A1 * 8/1991

OTHER PUBLICATIONS

Chen (Scripta Materialia, 2015, vol. 107, p. 131-135). (Year: 2015).*
English Abstract of SU 1669557. (Year: 1991).*

* cited by examiner

*Primary Examiner* — Xiaowei Su
(74) *Attorney, Agent, or Firm* — David Kelley; Brooks Kushman, P.C.

(57) ABSTRACT

A method of increasing volume ratio of magnetic particles in a MnBi alloy includes depositing a MnBi alloy powder containing magnetic particles and non-magnetic particles on a sloped surface having a magnetic field acted thereupon. The method further includes collecting falling non-magnetic particles while separated magnetic particles are magnetically retained on the sloped surface.

13 Claims, 3 Drawing Sheets

SEPARATION OF MANGANESE BISMUTH POWDERS

TECHNICAL FIELD

The present disclosure relates to a low temperature phase (LTP) manganese bismuth (MnBi) permanent magnet and a method of producing the same.

BACKGROUND

MnBi alloys have been identified as suitable substitutes for rare-earth permanent magnets because of their unique properties such as high coercivity which increases with temperature, thus providing higher stability in demagnetizing magnetic fields at high temperatures. This is particularly important for use in traction motors which normally operate at high temperatures. Obtaining a magnetic low temperature phase (LTP) MnBi alloy having high purity and high yield of the LTP remains difficult, partially because of the peritectic reaction between manganese (Mn) and bismuth (Bi), and because of the low phase transition temperature required to nucleate and grow MnBi LTP.

SUMMARY

In at least one approach, a method includes melting Mn and Bi into homogenous MnBi alloy and annealing the MnBi alloy to form bulk alloy. The method may further include crushing and milling the bulk alloy into powder. The method may further include directing the powder onto a sloped surface having a magnetic field acting thereupon such that MnBi LTP particles in the powder remain on the surface and non-magnetic Bi particles in the powder fall from the surface to separate the MnBi LTP particles and non-magnetic Bi particles.

In at least one approach, a method includes depositing MnBi alloy powder containing magnetic MnBi low temperature phase (LTP) particles and non-magnetic Bi particles on a sloped surface having a magnetic field of initial strength acting thereupon such that some of the magnetic MnBi LTP particles are retained on the sloped surface and the non-magnetic Bi particles fall from the sloped surface. The method may further include forming a magnet from the MnBi LTP particles retained on the sloped surface.

In at least one approach, a magnet is provided. The magnet may be formed by a method that may include melting Mn and Bi into homogenous MnBi alloy, and annealing the MnBi alloy to form bulk alloy. The method may further include crushing and milling the bulk alloy into powder including magnetic MnBi low temperature phase (LTP) particles and non-magnetic Bi particles. The method may further include depositing the powder on a sloped surface having a magnetic field acting thereupon. The method may further include collecting falling ones of the non-magnetic Bi particles at a lower portion of the sloped surface while separated ones of the magnetic MnBi LTP particles are magnetically retained on the sloped surface. The method may further include forming a magnet from the separated ones of the magnetic MnBi LTP particles.

In at least one approach, a method of increasing volume ratio of magnetic particles in a MnBi alloy is provided. The method may include depositing a MnBi alloy powder containing magnetic MnBi LTP particles and non-magnetic bismuth particles on a sloped surface having a magnetic field acted thereupon. The method may further include collecting falling non-magnetic bismuth particles while separated magnetic MnBi LTP particles are magnetically retained on the sloped surface.

In at least one approach, a MnBi alloy having an increased volume ratio of magnetic particles is provided. The MnBi alloy may be formed by a method that may include depositing a MnBi alloy powder containing magnetic MnBi LTP particles and non-magnetic particles on a sloped surface having a magnetic field acted thereupon. The method may further include collecting falling non-magnetic particles while separated magnetic MnBi LTP particles are retained on the sloped surface.

DETAILED DESCRIPTION

Figure 1:
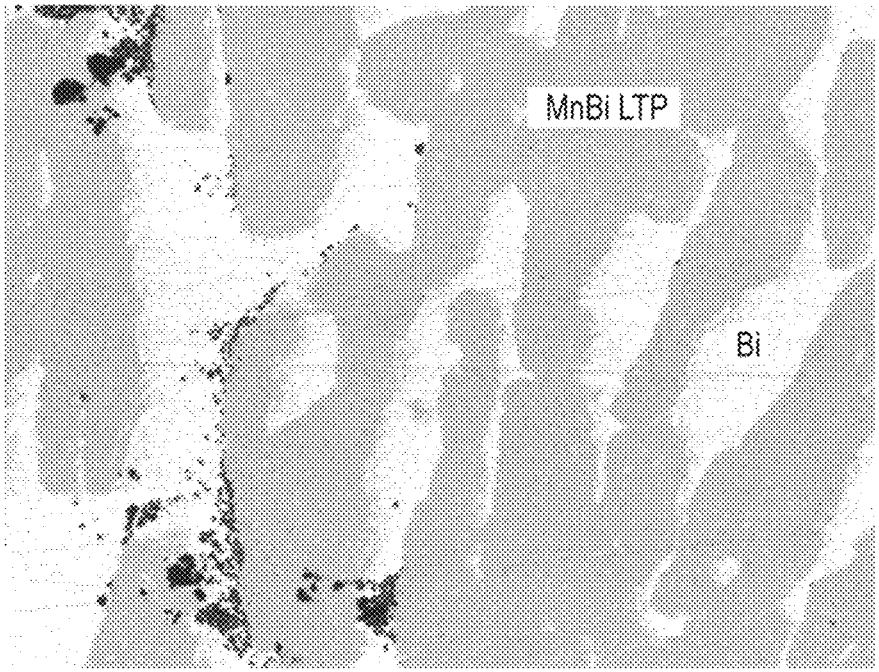
FIG. 1 depicts a SEM back scattered electron image of an arc-melted and annealed MnBi alloy.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Except where expressly indicated, all numerical quantities in this description indicating dimensions or material properties are to be understood as modified by the word "about" in describing the broadest scope of the present disclosure.

The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

Reference is being made in detail to compositions, embodiments, and methods of the present invention known to the inventors. However, it should be understood that disclosed embodiments are merely exemplary of the present invention which may be embodied in various and alternative forms. Therefore, specific details disclosed herein are not to be interpreted as limiting, rather merely as representative bases for teaching one skilled in the art to variously employ the present invention.

The description of a group or class of materials as suitable for a given purpose in connection with one or more embodiments of the present invention implies that mixtures of any two or more of the members of the group or class are suitable. Description of constituents in chemical terms refers to the constituents at the time of addition to any combination specified in the description, and does not necessarily preclude chemical interactions among constituents of the mixture once mixed. The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

A permanent magnet is a type of material which creates its own persistent magnetic field. Permanent magnets are used in a variety of applications. For example, in green energy applications such as electric vehicles or wind turbines, neodymium-iron-boron (Nd—Fe—B) magnet has been typically utilized. For such applications, the permanent magnets must be able to retain magnetism at high temperatures. Permanent magnet materials have been widely used in electric machines for a variety of applications including industrial fans, blowers and pumps, machine tools, household appliances, power tools, electric vehicles, and disk drives. For most of the applications, especially the high-end applications, for example, in electric vehicles, high performance rare earth permanent magnet materials are needed.

Rare earth elements, which are capable of generating a high anisotropic field, and thus have been essential component for high coercivity permanent magnets, have been typically used to produce such permanent magnets. In addition, heavy rare earth metals have been used to enhance coercivity to stabilize permanent magnets for high temperature operation. Rare earth materials are expensive, in particular, heavy rare earth materials are much more expensive than light rare earth materials, and supplies of those materials are at risk. There have been plenty of efforts in seeking for rare earth free permanent magnet materials.

Among the various types of the rare-earth-free permanent magnets, an MnBi magnet may be one of the most promising materials for high temperature permanent magnet applications. The low temperature phase (LTP) of the MnBi alloy has a high magnetic crystalline anisotropy of $1.6\times10^6$ $Jm^{-3}$. The ferromagnetic LTP of the MnBi alloy has a unique feature, specifically, coercivity of the LTP of the MnBi alloy has a large positive temperature coefficient, which means that the coercivity of a magnet made from the LTP MnBi increases with increasing temperature. This unique feature makes the MnBi magnet an excellent candidate for high temperature applications to replace rare earth-based permanent magnet which normally contains even more expensive heavy rare earth elements for high temperature applications, or at least to decrease the dependence on the heavy rare earth elements.

Yet, the saturation magnetization of the MnBi alloy is relatively low at about 0.9 T at 300 K. The MnBi alloy is usually composed of other phases such as non-magnetic Mn and Bi, which are phases that do not contribute to the magnetic property. The MnBi magnet can be either used directly as a permanent magnet or for exchange coupled nanocomposite magnets. A prerequisite for all the applications is that the magnet has high purity MnBi LTP. But achieving a high volume ratio of the MnBi LTP in the MnBi alloy has been problematic.

MnBi LTP is typically prepared from Mn—Bi alloys, but the phase transition from the individual Mn phase and Bi phase to MnBi LTP occurs below 360° C., which is very low for the atoms to overcome the energy barriers for phase transition. Due to the low temperature and low-energy atoms, the phase transition is typically extremely slow, resulting in complicated and expensive approaches to prepare the magnet. These approaches include methods like melt spinning, ball milling, and arc melting followed by annealing. Using processes like these are typically very expensive, rendering them difficult to scale up for mass production.

Conventional metallurgical methods such as arc melting and sintering may be economically feasible, but the MnBi alloy prepared by these methods contains a relatively high volume of non-magnetic Mn and Bi phases because the reaction between Mn and Bi is peritectic such that a solid phase and a liquid phase form a second solid phase at a certain temperature. During solidification, Mn solidifies into big grains first out of the MnBi liquid. A heat treatment or annealing is performed at a low temperature to get the MnBi LTP. Yet, the volume ratio of the MnBi LTP is limited by the nature of the peritectic reaction and by the low reaction temperature. The reaction between Mn and Bi is slow, pure MnBi LTP is still not achievable even after various heat treatments, and the complicated, long time heat treatment significantly increases the cost.

According to one or more approaches, a method of preparing an MnBi LTP magnet includes mixing and sintering powders of individual components Mn and Bi. As far as the powders are mixed homogeneously, efficiency of the processing may be less affected by the volume of the alloy, which may make the method easier to scale up for mass production. Powders of Mn and Bi may be mixed using a mixer, cryo-miller, or low energy ball miller. The Mn powder and Bi powder may be mixed with an atomic ratio of between about 0.8:1 to 1:0.8. In one approach, the Mn and Bi powder are mixed with an atomic ratio of about 1:1. The mixed powder may then be pressed into compacts, such as green compacts. The compacts may be then sintered in an inert gas atmosphere, such as argon, nitrogen, or helium. The atmosphere may also be mixture of these inert gases, or mixture of inert gases with hydrogen since hydrogen can prevent oxide formation.

After an annealing process, the Mn—Bi alloy typically contains Mn, Bi, and MnBi LTP. Even after a pulverization process, each particle may still contain a mixture of ferromagnetic MnBi LTP and bismuth. An example MnBi alloy prepared by arc melting and annealing is depicted in FIG. 1. The depicted MnBi alloy composite material shows the MnBi LTP in dark gray color and the non-magnetic unreacted metal Bi phase in light gray color.

Separation of MnBi LTP has been found to be difficult because the component phases in the mixture are often sticky. However, among all of the phases, only MnBi LTP is ferromagnetic. Therefore, as described herein, magnetic separation may be possible for such a mixture.

In one or more approaches, a method of increasing volume ratio of magnetic particles in an alloy is disclosed. In one example, a method of increasing volume ratio of magnetic particles in a MnBi alloy is disclosed. An advantage of the process described herein lies in the ability to utilize a MnBi alloy prepared by methods such as arc-melting and annealing, and increase the MnBi LTP of such alloy powder so that the alloy powder becomes suitable for the permanent magnet applications.

The MnBi alloys can be prepared by arc-melting of a mixture of Mn and Bi with a molar ratio of about 1:1, although a MnBi alloy prepared by other methods may be likewise suitable. Different ratios of Mn:Bi are contemplated. For example, the MnBi alloy may have a ratio of Mn:Bi of about 0.5:1, 1:1, 1:1.5, 1:2, 1:2.5, 1:3, 1:4, 1:5, 1:6, 1:7, 1:8, 1:9, 1:10 or 10:1, 9:1, 8:1, 7:1, 6:1, 5:1, 4:1, 3:1, 2.5:1, 2:1, 1.5:1, 1:1, 1:0.5, or the like.

The MnBi alloy may then be annealed at temperatures between about 200° C. to 700° C., 260° C. and 500° C., or 300° C. and 400° C.; for example, at approximately 360° C. The MnBi alloy may be annealed, for example, for 2-12 hours. The MnBi alloy may be annealed for about 1 to 40 hours; for example, and more particularly, for about 2 to 12 hours.

The annealed MnBi alloy can be crushed and/or milled into a powder. The crushing may be conducted mechanically or manually (e.g., low energy ball milled or cryo-milled) into powders. The annealed alloy may be shaped into an ingot. The particle size of the powder may be about 1 μm to about 500 μm, 100 μm to 500 μm, 100 μm to 400 μm, or 200 μm to 300 μm.

In at least one approach, the method may include a sieving operation. For example, prior to magnetic field separation, the MnBi alloy powder may be sieved. Sieving of the MnBi alloy powder may exclude relatively large particles. Sieving may be particularly useful when mechanical milling was performed during powder preparation. As bismuth is relatively ductile, bismuth-rich particles may form flat sheets. The bismuth-rich particles may be separated by sieving.

Figure 2:
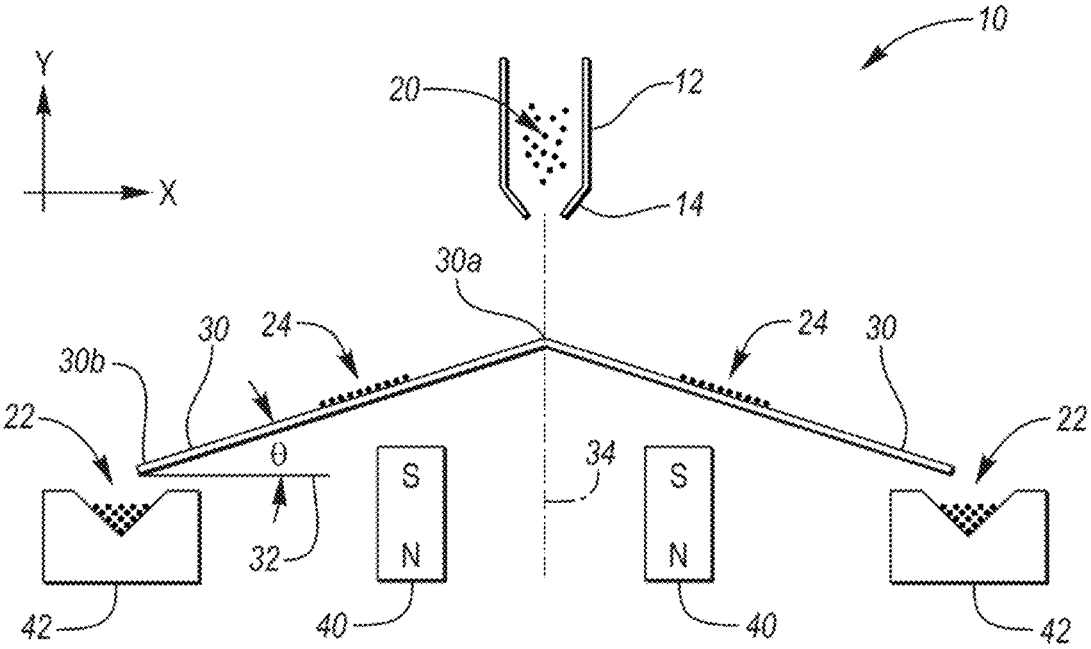
FIG. 2 is a schematic of a first assembly for separating powders of a MnBi alloy.

Referring now to FIG. 2, an assembly 10 for separating MnBi LTP particles from MnBi alloys is depicted. The assembly 10 includes a tank 12 that includes a nozzle 14. The tank 10 may be adapted to receive MnBi alloy powders, indicated at 20. The tank 12 may be a movable tank. A movable tank 12 may provide better control over the powder spreading. In one approach, the tank 12 may have a dimension (e.g., a length) that may correspond to a surface disposed below the tank 12. The nozzle 14 may define an aperture that may be, for example, a round aperture. In still other approaches, the nozzle 14 may define a non-circular aperture, such as a slit. The slit may be a sloped slit, and may have an angle of inclination that may correspond to an angle of inclination of a sloped surface disposed below the nozzle 14. In at least one approach, a valve may be provided; for example, at or below (e.g., vertically below) the nozzle 14. In this way, flow of the powder from the tank 12 to a below surface may be controlled.

One or more sloped surfaces 30 may be disposed below the nozzle 14 (e.g., gravitationally below). In this way, MnBi alloy powders 20 released from the tank 12 (e.g., through the nozzle 14) may be deposited on the sloped surface 30. As used herein a sloped surface 30 may extend at an oblique angle θ (referred to herein as an angle of inclination) relative to a plane 32 that may be disposed orthogonal to a vertical axis 34. The vertical axis 34 may correspond to a drop axis (e.g., gravitational drop axis), and may also correspond to a central axis of the tank 12 and/or nozzle 14.

In this way, the sloped surface 30 may have an angle of inclination in a range of approximately 15 degrees to approximately 75 degrees, approximately 15 degrees to approximately 45 degrees, and for example approximately 30 degrees. As used herein, "approximately" may correspond to +/−5 degrees. The angle of inclination may be adjustable. For example, the angle may be adjusted prior to, during, or after the MnBi alloy powder is deposited on the sloped surface 30.

The angle of inclination may be selected as a function of the magnetic field gradient, and can vary in a relatively large range. For example, if the magnetic field is relatively weak, the angle may be selected within a first range (e.g., approximately 15 degrees to approximately 25 degrees). If the magnetic field is relatively strong, the angle may be selected within a second range that may have one or more values greater than the first range (e.g., approximately 55 degrees to approximately 75 degrees).

In at least one approach, the sloped surface 30 may be a planar surface, and may be a smooth surface. For example, the sloped surface 30 may have a polished finish. The sloped surface 30 may be made of non-ferromagnetic metal, ceramic, or one or more hard plastic sheets. The sloped surface 30 may be vibrated or sonicated. In this way, particles deposited on the sloped surface 30 may be directed from an upper portion 30*a* of the sloped surface 30 (e.g., adjacent the nozzle 14) to a lower portion 30*b* of the sloped surface 30 (e.g., opposite the nozzle 14) as aided, for example, by gravity and movement of the sloped surface 30. Furthermore, vibration or sonication of the sloped surfaces 30 may prevent powders from forming long chains along field direction due to magneto static interaction, which may prevent powders from flowing.

As shown in FIG. 2, the assembly 10 may include two planar sloped surfaces 30. The two sloped surfaces may define an inverted-V or an inverted V-shaped structure. The inverted-V may define an apex, and it at least one approach, the MnBi alloy powder may be deposited proximate the apex.

Figure 3:
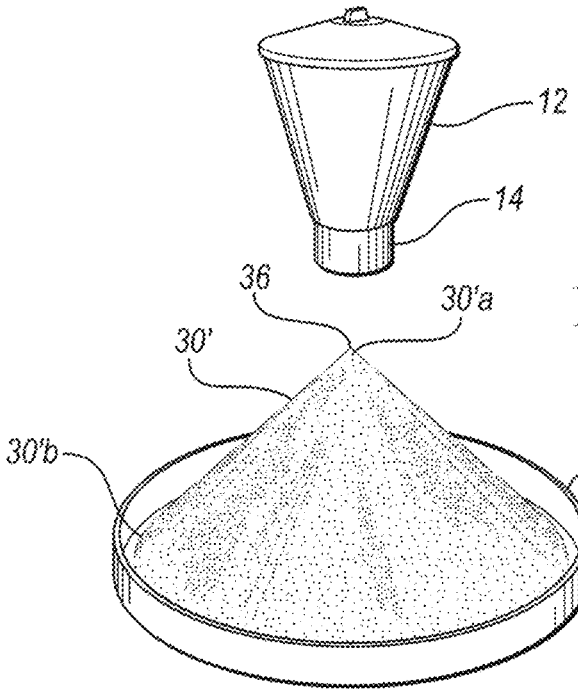
FIG. 3 is a perspective view of a second assembly for separating powders of a MnBi alloy.

Referring momentarily to FIG. 3, the sloped surface may be a conical sloped surface 30' that may have an apex 36 disposed at an upper portion 30'*a* below the nozzle 14 of the tank 12 opposite a lower portion 30'*b*.

Referring again to FIG. 2, one or more magnets 40 may be disposed below the sloped surface 30. The magnets 40 may be disposed vertically below the sloped surface 30 such that the sloped surface 30 extends between the magnets 40 and the nozzle 14.

The magnets 40 may be permanent magnets (e.g., and arrays of permanent magnets), electromagnets, other magnets, or any suitable combination thereof. The magnet 40 may be a single magnet (e.g., a single permanent magnet), or may be an array of magnets. An array of magnets may form periodical field gradient. The magnet 40 may be attached to a lower surface of the sloped surface 30, or may be spaced from the lower surface of the sloped surface 30. For example, when the magnet 40 is a permanent magnet or permanent magnet array, the distance between the sloped surface and the magnet 40 may be adjusted. Furthermore, multiple magnets may be used to provide different magnetic fields (e.g., at the same time). For example, a first magnet may provide a relatively weaker magnetic field at the upper portion 30*a* of the sloped surface 30, and a second magnet may provide a relatively stronger magnetic field at the lower portion 30*b* of the sloped surface 30. In this way, as will be appreciated, powders trapped by the first magnet against the sloped surface 30 may have higher purity of high-magnetic content as compared to powders trapped by the second magnet.

In at least one approach, a dimension of a magnet 40 may correspond to a dimension of the sloped surface 30. For example, a magnet 40 may extend along an entire length (or substantially entire length) of the sloped surface 30 (e.g., as defined by an axis extending within the X-Y plane of FIG. 2). In still another example, a magnet 40 may extend along an entire width (or substantially entire width) of the sloped surface 30 (e.g., as defined by an extending orthogonal to the X-Y plane of FIG. 2). Still further, a magnet 40 may have width greater than a width of the sloped surface 30.

The magnets 40 may generate a magnetic field at the sloped surface 30. In this way, the magnets 40 may be capable of maintaining (e.g., magnetically maintaining) at least a portion of the MnBi alloy powders 20 against the sloped surface 30. For example, when the MnBi alloy powders 20 are released from the nozzle 14 and fall onto the sloped surface 30, the magnetic field gradient generated by the magnet 40 may hold MnBi alloy powders 20 from flowing down if the powder is ferromagnetic and the force acting on the ferromagnetic portions of powder is:

$$F = \frac{1}{2}\mu_0 \chi V \nabla^2 H$$

Here, $\mu_0$ is the vacuum permeability, $\chi$ is magnetic susceptibility of the ferromagnetic material, V is the volume of the powders, and H is the magnetic field. The magnetic field gradient may be adjusted, for example, by moving the position of the magnets 40.

It has been found that the competition between the gravity and the magnetic forces acting on the powders determines whether the powder would flow down the sloped surface 30 or remain on it. For powders containing high content of Bi, indicated at 22 in FIG. 2, the magnetic force acting on the powders is smaller due to the non-magnetic Bi phase than the powders of the same size containing only MnBi LTP. In this way, high-content Bi powders have a greater tendency to flow down the sloped surface 30, while high-content MnBi LTP powders, indicated at 24 in FIG. 2, are more likely to be magnetically maintained against the sloped surface 30. In this way, powders containing different volume ratio of MnBi LTP can be separated from the initial collection of MnBi alloy powders.

The assembly 10 may include one or more bins 42. For example, one or more bins 42 may be provided for each individual sloped surface. In the approach shown in FIG. 2, two bins 42 are provided. In the approach shown in FIG. 3, a single annular bin 42' may be provided. The annular bin 42' may extend about an entire perimeter of the sloped surface 30'.

The bins 42 may be disposed below (e.g., gravitationally below) the sloped surfaces 30. For example, the bins 42 may be disposed below lower portions 30*b* of the sloped surfaces 30. In this way, powder that falls from the lower portions 30*b* of the sloped surfaces 30 may be collected in the bins 42. Due at least in part to the low magnetic nature of the high-content Bi powders 22, the powders collected in the bins 42 may primarily be high-content Bi powders 22 when the magnetic field is acting on the sloped surface 30.

The bins 42 may be moved (e.g., tilted) such that once the separation is done, the non-magnetic particles 22 collected in the bins 42 may be retrieved. The powders of low purity MnBi LTP may be simply recycled for the preparation of Mn—Bi alloys. Once the powders of low purity MnBi LTP have been removed from the bins 42, the bins 42 can be reused to collect the MnBi LTP powders 24 trapped by the magnetic field. To do so, the magnetic field can be switched off or moved away such that the MnBi LTP powders 24 are free to flow down the sloped surface 30 to the bins 42 for collection. In still another approach, different bins than those used to collect the powders of low purity MnBi LTP may be used to collect the MnBi LTP powders 24.

A desirable volume ratio of the MnBi LTP in the powder achievable by the process described herein may be up to about 99 vol. %. The volume ratio of the MnBi LTP in the powder achievable by the process described herein may be at least about 90, 91, 92, 93, 94, 95, 95.5, 96, 96.5, 97, 97.5, 98, 98.5, 99 vol. %.

In at least one approach, separation process described here can be done in air, or in a protective atmosphere. After each separation step, powders collected in the bins 42 may be placed back into the tank 12 to be further separated by a subsequent separating step. In the second separating step, the magnetic field below the sloped surface 30 may be adjusted (e.g., decreased). The process may be repeated one or more times. The process can thus last 1, 2, 3, 4, 5, 8, 10, 15 cycles or more.

As such, in at least one approach, an initial magnetic force may be reduced such that the magnetic MnBi LTP powders fall along the sloped surface 30. The magnetic MnBi LTP powders may then be collected. The method may further include adjusting a magnetic force of the magnetic field to a subsequent magnetic force that has a magnitude less than the initial magnetic force. The method may further include redepositing the magnetic MnBi LTP powders on the sloped surface 30.

EXAMPLE

Figure 4:
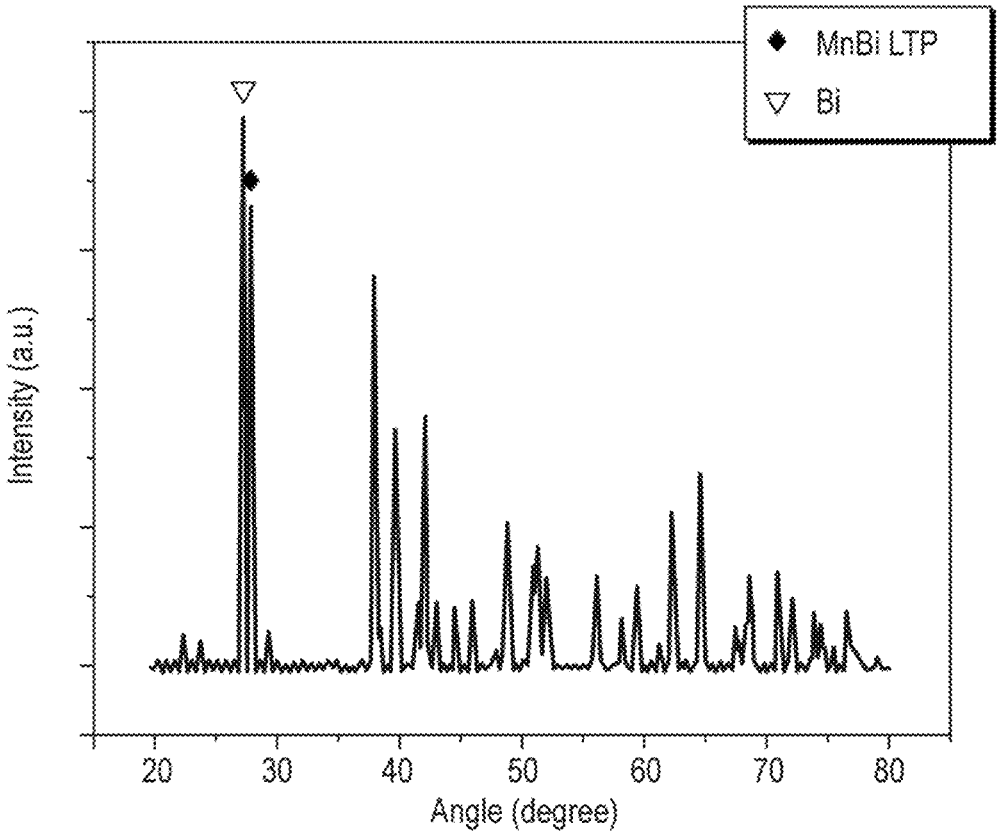
FIG. 4 is a graph showing x-ray diffraction patterns of Mn—Bi powders after annealing and prior to separating.

A MnBi powder with atomic ratio of Mn:Bi being 1:1 was arc-melted and subsequently annealed. FIG. 4 shows the x-ray diffraction pattern of the MnBi powder before separation, with the strongest peaks of both Bi and MnBi LTP labeled separately. The relative intensity between these two peaks reflects their volume ratio.

Figure 5:
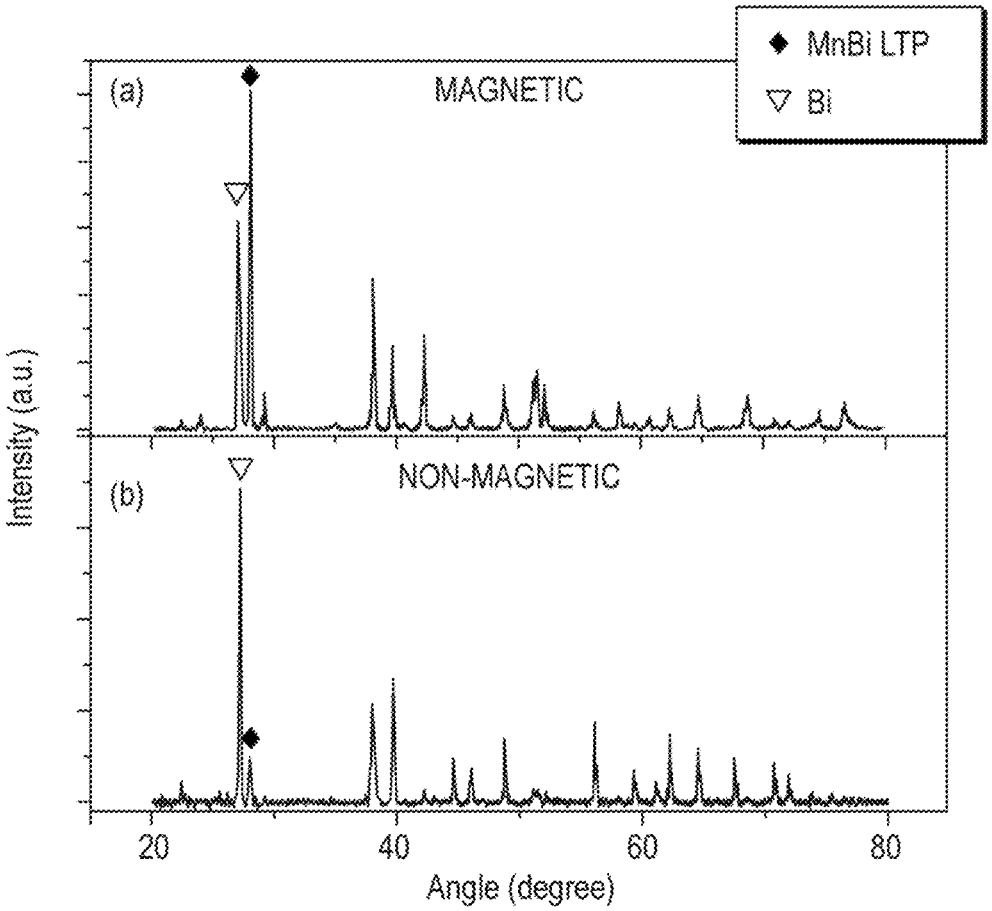
FIG. 5 is a graph showing x-ray diffraction patterns of Mn—Bi powders after separating.

To separate the Mn—Bi alloy powders, a magnetic field gradient was generated by a ferrite magnet. The powders were placed on top of a sloped plastic sheet, which was sonicated. Non-magnetic powders fell down the sheet and were collected. The ferrite magnet was then removed and the powders remaining on the sheet (i.e., the magnetic powders) were collected separately. As can be seen in FIG. 5, after separation, the non-magnetic powders contained almost no MnBi LTP phase, while the MnBi LTP phase volume ratio was highly increased in the magnetic powders as compared with the initial powders.

While exemplary embodiments are described above, it is not intended that these embodiments describe all possible forms encompassed by the claims. The words used in the specification are words of description rather than limitation, and it is understood that various changes may be made without departing from the spirit and scope of the disclosure. As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. A method comprising:

melting Mn and Bi into homogenous MnBi alloy;

annealing the MnBi alloy to form bulk alloy;

crushing the bulk alloy into powder; and directing the powder onto a sloped surface having a magnetic field acting thereupon such that MnBi particles in the powder remain on the surface and non-magnetic Bi particles in the powder fall from the surface to separate the MnBi particles and non-magnetic Bi particles, wherein the sloped surface is a plurality of adjacent planar sloped surfaces that define an inverted-V defining an apex, and wherein the powder is directed proximate the apex.

2. The method of claim 1 further comprising vibrating the sloped surface during the directing.

3. The method of claim 1 further comprising adjusting an angle of inclination of the sloped surface during the directing.

4. The method of claim 1 further comprising adjusting a strength of the magnetic field during the directing.

5. The method of claim 1 wherein the directing includes directing the powder onto an apex of the sloped surface.

6. The method of claim 1 wherein the magnetic field is applied to the sloped surface using one or more magnets disposed below the sloped surface.

7. The method of claim 6 wherein the one or more magnets are a plurality of permanent magnets adapted to be moved toward and away from the sloped surface.

8. The method of claim 6 wherein the one or more magnets includes an electromagnet, wherein the MnBi particles are magnetically maintained when an electric current is provided to the electromagnet, and wherein the MnBi particles are not magnetically maintained when the electric current is reduced.

9. The method of claim 1, wherein the directing includes dropping the powder from a nozzle disposed vertically above at least a portion of the sloped surface.

10. The method of claim 1 wherein non-magnetic Bi particles are collected in one or more bins disposed vertically below bottom portions of the planar sloped surfaces.

11. The method of claim 1 wherein the sloped surface has an angle of inclination in a range of approximately 15 degrees to approximately 75 degrees.

12. The method of claim 11 wherein the angle of inclination is in a range of approximately 15 degrees to approximately 45 degrees.

13. A method comprising:

depositing MnBi alloy powder containing magnetic MnBi low temperature phase (LTP) particles and non-magnetic Bi particles on a sloped surface having a magnetic field of initial strength acting thereupon such that some of the magnetic MnBi LTP particles are retained on the sloped surface and the non-magnetic Bi particles fall from the sloped surface;

reducing the magnetic field to release the MnBi LTP particles retained on the sloped surface;

collecting the magnetic MnBi LTP particles released from the sloped surface;

increasing the magnetic field to a secondary strength less than the initial strength; and depositing the collected magnetic MnBi LTP particles on the sloped surface; and forming a magnet from the MnBi LTP particles retained on the sloped surface.

* * * * *